US005820435A

United States Patent [19]

Cooper et al.

[11] Patent Number: 5,820,435

[45] Date of Patent: Oct. 13, 1998

[54] GAP JUMPING TO SEAL STRUCTURE INCLUDING TACKING OF STRUCTURE

[75] Inventors: Anthony J. Cooper, Escondido; Floyd R. Pothoven, Hawthorne; Paul N. Ludwig, Livermore; Theodore S. Fahlen, San Jose; Robert J. Pressley, Cupertino, all of Calif.

[73] Assignee: Candescent Technologies Corporation, San Jose, Calif.

[21] Appl. No.: 766,474

[22] Filed: Dec. 12, 1996

[51] Int. Cl.[6] ..... H01J 9/26

[52] U.S. Cl. ..... 445/25; 445/43; 65/58

[58] Field of Search ..... 445/24, 25, 43; 65/58

[56] References Cited

U.S. PATENT DOCUMENTS

| | | | |
|---|---|---|---|
| 3,874,549 | 4/1975 | Hascoe | 174/52.4 |
| 4,021,219 | 5/1977 | Stockdale et al. | 65/43 |
| 4,618,801 | 10/1986 | Kakino | 313/495 |
| 5,424,605 | 6/1995 | Lovoi | 313/422 |
| 5,477,105 | 12/1995 | Curtin et al. | 313/422 |
| 5,489,321 | 2/1996 | Tracy et al. | 65/43 |
| 5,589,731 | 12/1996 | Fahlen et al. | 313/495 |
| 5,693,111 | 12/1997 | Kadowaki et al. | 65/58 |
| 5,697,825 | 12/1997 | Dynka et al. | 445/25 |

OTHER PUBLICATIONS

Branst et al, "The Challenge of Flat Panel Display Sealing," *Semiconductor Int'l,* Jan. 1996, pp. 109–112.

Jellison et al, "Laser Materials Processing at Sandia National Labatories," Applications of Lasers and Electro–optics, Conference, 17–20 Oct. 1994, sponsored by Dept. of Energy, 10 pps.

Tannas, *Flat–Panel Displays and CRTs* (Van Nostrand Reinhold), Section 7.9, 1985, pp. 217–221.

Zimmerman et al, "Glass Panel Alignment and Sealing for Flat–Panel Displays," Viewgraph Presentation, NCAICM Workshop, Contract No. F33615–94–C–1415, 30 Nov.–2 Dec. 1994, 29 viewgraphs.

Zimmerman et al, "Glass Panel Alignment and Sealing for Flat–Panel Displays," Contract Summary, ARPA High Def. Systs. Info. Exch. Conf., 30 Apr. –3 May 1995, 2 pp.

*Primary Examiner*—Kenneth J. Ramsey

*Attorney, Agent, or Firm*—Skjerven, Morrill, MacPherson, Franklin & Friel LLP; Ronald J. Meetin

[57] ABSTRACT

A structure, such as a flat-panel device, is sealed together by a gap-jumping technique in which an edge (44S) of a wall (44) is positioned near a matching sealing area (40S) of a plate structure (40) such that a gap (48) at least partially separates the edge of the wall from the sealing area of the plate structure. The gap usually has an average height of 25 μm or more. Energy is then transferred locally to material of the wall along the gap to cause material of the wall and the plate structure to bridge the gap and seal the plate structure to the wall. The energy-transferring step is typically performed with light energy provided by a laser (56). Local energy transfer can also be utilized to tack the plate structure to the wall at multiple spaced-apart locations (44A) along the wall. The tacking operation is typically performed as a preliminary step to sealing the plate structure to the wall.

40 Claims, 4 Drawing Sheets

GAP JUMPING TO SEAL STRUCTURE INCLUDING TACKING OF STRUCTURE

FIELD OF USE

This invention relates to techniques for sealing structures, particularly flat-panel devices. This invention also relates to techniques for tacking structures, such as flat-panel devices, typically as part of structure sealing operations.

BACKGROUND ART

A flat-panel device contains a pair of generally flat plates connected together through an intermediate mechanism. The two plates are typically rectangular in shape. The thickness of the relatively flat structure formed with the two plates and the intermediate connecting mechanism is small compared to the diagonal length of either plate.

When used for displaying information, a flat-panel device is typically referred to as a flat-panel display. The two plates in a flat-panel display are commonly termed the faceplate (or frontplate) and the baseplate (or backplate). The faceplate, which provides the viewing surface for the information, is part of a faceplate structure containing one or more layers formed over the faceplate. The baseplate is similarly part of a baseplate structure containing one or more layers formed over the baseplate. The faceplate structure and the baseplate structure are sealed together, typically through an outer wall, to form a sealed enclosure.

A flat-panel display utilizes mechanisms such as cathode rays (electrons), plasmas, and liquid crystals to display information on the faceplate. Flat-panel displays that employ these three mechanisms are generally referred to as cathode-ray tube ("CRT") displays, plasma displays, and liquid-crystal displays. The constituency and arrangement of the display's faceplate structure and baseplate structure depend on the type of mechanism utilized to display information on the faceplate.

In a flat-panel CRT display, electron-emissive elements are typically provided over the interior surface of the baseplate. The electron-emissive elements are arranged in a matrix of rows and columns of picture elements (pixels). Each pixel typically contains a large number of individual electron-emissive elements. When the electron-emissive elements are appropriately excited, they emit electrons that strike phosphors arranged in corresponding pixels situated over the interior surface of the faceplate.

The faceplate in a flat-panel CRT display consists of a transparent material such as glass. Upon being struck by electrons emitted from the electron-emissive elements, the phosphors situated over the interior surface of the faceplate emit light visible on the exterior surface of the faceplate. By appropriately controlling the electron flow from the baseplate structure to the faceplate structure, a suitable image is displayed on the faceplate.

The electron-emissive elements in a flat-panel CRT display typically emit electrons according to a field-emission (cold emission) technique or a thermionic emission technique. In either case, but especially for the field-emission technique, electron emission needs to occur in a highly evacuated environment for the CRT display to operate properly and to avoid rapid degradation in performance. The enclosure formed by the faceplate structure, the baseplate structure, and the outer wall is thus fabricated in such a manner as to be at a high vacuum, typically a pressure of $10^{-7}$ torr or less for a flat-panel CRT display of the field-emission type. One or more spacers are commonly situated between the faceplate structure and the baseplate structure to prevent outside forces, such as air pressure, from collapsing the display.

Any degradation of the vacuum can lead to various problems such as non-uniform brightness of the display caused by contaminant gases that degrade the electron-emissive elements. The contaminant gases can, for example, come from the phosphors. Degradation of the electron-emissive elements also reduces the working life of the display. It is thus critical to hermetically seal a flat-panel CRT display.

A flat-panel CRT display of the field-emission type, often referred to as a field-emission display ("FED"), is conventionally sealed in air and then evacuated through pump-out tubulation provided on the display. FIGS. 1*a*–1*d* (collectively "FIG. 1") illustrate one such conventional procedure for sealing an FED consisting of a baseplate structure 10, a faceplate structure 12, an outer wall 14, and multiple spacer walls 16.

At the point shown in FIG. 1*a*, spacer walls 16 are mounted on the interior surface of faceplate structure 12, and outer wall 14 is connected to the interior surface of faceplate structure 12 through frit (sealing glass) 18 provided along the faceplate edge of outer wall 14. Frit 20 is situated along the baseplate edge of outer wall 14. A tube 22 is sealed to the exterior surface of baseplate structure 10 through frit 24 at an opening 26 in baseplate structure 10. A getter 28 for collecting contaminant gases is typically provided along the inside of tube 22. The structure formed with baseplate structure 12, outer wall 14, and spacer 16 is physically separate from the structure formed with baseplate structure 10, tube 22, and getter 28 prior to sealing the display.

Structures 12/14/16 and 10/22/28 are placed in an alignment fixture 30, aligned to each other, and brought into physical contact along frit 20 as shown in FIG. 1*b*. Alignment fixture 30 is located in, or is placed in, an oven 32. After being aligned and brought into contact, structures 12/14/16 and 10/22/28 are slowly heated to a sealing temperature ranging from 450° C. to greater than 600° C. Frit 20 melts, sealing structure 12/14/16 to structure 10/22/28. The sealed FED is slowly cooled down to room temperature. The heating/sealing/cool-down process typically takes 1 hr.

After having been sealed, the FED is removed from alignment fixture 30 and oven 32, and is placed in another oven 34. See FIG. 1*c*. A vacuum pumping system 36 is connected to tube 22. With a heating element 38 placed around tube 22, the FED is pumped down to a vacuum level through tube 22. The FED is then brought slowly up to a high temperature and baked for several hours to remove contaminant gases from the material of the FED. When a suitable low pressure can be maintained in the FED at the elevated temperature, the FED is cooled to room temperature, and tube 22 is heated through heating element 38 until tube 22 closes to seal the FED at a high vacuum. The FED is then removed from oven 34 and disconnected from vacuum pump 36. FIG. 1*d* shows the sealed FED.

The sealing process of FIG. 1 is unsatisfactory for a number of reasons. Even though multiple FEDs can be sealed at the same time, the sealing procedure often takes too long to meet commercial needs. In addition, the entire FED is heated to a high temperature for a long period. This creates concerns relating to alignment tolerances and can degrade certain of the materials in the FED, sometimes leading to cracking. Furthermore, tube 22 protrudes out of the FED. Consequently, the FED must be handled very carefully to avoid breaking tube 22 and destroying the FED. It would be extremely beneficial to have a technique for sealing a flat-panel device, especially a flat-panel display of the field-emission CRT type, that overcomes the foregoing problems and eliminates the need for pump-out tubulation such as tube 22.

GENERAL DISCLOSURE OF THE INVENTION

The present invention furnishes a technique for sealing portions of a structure together in such a manner that the sealed structure can readily achieve a reduced pressure state, typically a high vacuum level, without the necessity for providing the structure with an awkward pressure-reduction device, such as pump-out tubulation, that protrudes substantially beyond the remainder of the sealed structure. In the invention, sealing is effected by a gap-jumping technique in which energy is applied locally along a specified area to create the seal. The term "local" or "locally" as used here in describing an energy transfer means that the energy is directed selectively to certain material largely intended to receive the energy without being significantly transferred to nearby material not intended to receive the energy.

In using the gap-jumping technique of the invention to seal a structure, the entire structure is typically heated prior to completing the seal in order to drive out contaminant gases and alleviate stress that might otherwise arise during completion of the seal. However, the maximum temperature reached during the outgassing/stress-relieving operation, typically in the vicinity of 300° C., is much less than that normally reached in prior art sealing processes such as that described above in which sealing is performed by global heating. Problems such as cracking and degradation of the components of the structure are greatly reduced with the present gap-jumping sealing technique.

The sealing technique of the invention can be performed in much less time than a prior art sealing process of the type described above. The present sealing technique is particularly suitable for sealing a flat-panel device, especially a flat-panel display of the CRT type. With the necessity for awkwardly protruding pump-out tubulation eliminated, the possibility of destroying the sealed structure by breaking a pump-out tube is avoided. In short, the invention provides a large advantage over prior art hermetic sealing techniques.

More particularly, the sealing technique of the invention entails positioning a first edge of a primary wall (e.g., an outer wall of a flat-panel display) near a matching sealing area of a first plate structure (e.g., a baseplate structure of a flat-panel display) such that a gap at least partially separates the first edge of the wall from the sealing area of the first plate structure. The gap usually has an average height of at least 25 $\mu$m. Energy, typically light energy, is then transferred locally to material of the wall along the gap to cause material of the wall and first plate structure to bridge the gap and seal the first plate structure to the wall. In the typical case, material of the wall bridges largely all of the gap. The gap-bridging local energy transfer is typically performed with a laser.

Depending on the geometry of the structure to be sealed, on the materials used in the structure, and on the conditions of the local energy transfer, one or more of several mechanisms appear to be responsible for gap jumping in the present invention. One mechanism is surface tension. As energy is locally transferred to material of the wall along at the gap, the wall material along the gap melts and, especially if the wall material along the gap is relatively flat up to a pair of corners, attempts to occupy a volume having a reduced surface area. This causes wall material along the gap to curve towards the sealing area of the first plate structure.

Gases trapped in material of the wall along the gap, or created by changes in the composition of the wall material along the gap, may help cause wall material along the gap to move towards the sealing area of the first plate structure. Also, in some cases, material of the wall along the gap may undergo a phase change that results in a decrease in density so that the volume of the wall material increases, causing it to expand towards the sealing area of the first plate structure.

In any event, the molten wall material along the gap comes into contact with the material of the first plate structure along its sealing area, wets that material, and flows to form a seal. The net result is that application of local energy to the wall material along the gap causes the gap to be closed. The gap must, of course, be sufficiently small so as to be capable of being bridged due to the local energy transfer. We have successfully jumped gaps of up to 300 $\mu$m utilizing local light energy transfer in accordance with the invention.

A second edge of the wall opposite the first edge is typically sealed to a second plate structure (e.g., a faceplate structure of a flat-panel display) along another matching sealing area. Sealing of the second plate structure to the wall is typically done before sealing the first plate structure to the wall.

The two plate structures and the wall preferably are in a vacuum environment as the local energy transfer step is being completed. With the plate structures and wall forming an enclosure, operating in this manner results in a vacuum, typically a high vacuum, being created in the enclosure. Importantly, the vacuum is created during the end of the sealing procedure without using a device such as a pump-out tube to produce the vacuum.

Inasmuch as material of the wall along the gap normally melts at a lower temperature than material of the first plate structure along its sealing area, the sealing process of the invention can be enhanced by locally transferring energy to material of the first plate structure along its sealing area so as to raise that material to a temperature close to the melting temperature of the wall material along the gap. This further local energy transfer can be initiated before initiating the local transfer of energy to the wall for producing gap jumping. Alternatively, the local transfer of energy to the first plate structure can be performed at the same time as the local transfer of energy to the wall, typically using a single energy source. Locally heating both the first plate structure and the wall in this way provides stronger bonding at the seal interface and thus increases the hermeticity of the seal.

The invention also furnishes a technique for tacking (partially joining) two parts of a structure together at multiple locations. The tacking operation is normally performed as part of an overall sealing operation for holding the two parts of the structure in a fixed position relative to each other while sealing of the structure is being completed. The present tacking technique is fully compatible with the gap-jumping sealing technique of the invention, thereby enabling the sealing operation to be done very economically.

More specifically, the tacking technique of the invention involves positioning a first edge of a primary wall (again, e.g., an outer wall) adjacent to a matching prescribed area of a first plate structure (again, e.g., a baseplate structure). A gap, again normally at least 25 $\mu$m in average height, typically separates the wall's first edge from the first plate structure's prescribed area. When the present tacking technique is part of an overall sealing operation, the prescribed area of the first plate structure is the area along which the first plate structure and wall are sealed together.

Energy, again typically light energy, is transferred locally to multiple spaced-apart portions of material of the wall along its first edge so as to tack the first plate structure to the wall at corresponding spaced-apart locations. When the gap is present, the local energy transfer causes material of the wall and first plate structure to bridge the corresponding spaced-apart sections of the gap. As a result, the wall and first plate structure are tacked (or partially joined) together at multiple locations along the sealing interface. A laser is typically employed to perform the tacking operation.

Sealing of the first plate structure to the wall is subsequently completed by closing the remainder of the gap, preferably by using local energy transfer to produce gap jumping in the manner described above. With a second plate structure (again, e.g., a faceplate structure) being sealed to a second edge of the wall opposite the first edge, the resulting structure typically forms a sealed enclosure of the flat-panel type. In short, the invention furnishes a highly consistent, effective technique for hermetically sealing a flat-panel device, especially a flat-panel display of the CRT type.

BRIEF DESCRIPTION OF THE DRAWINGS

FIGS. 2*b and 2*c are cross-sectional views representing additional steps employable according to the invention in the gap-jumping sealing process of FIGS. 2*a*–2*e*.

FIGS. 2*c*' and 2*d*' are cross-sectional views representing steps substitutable according to the invention for the steps of FIGS. 2*c* and 2*d* in the gap-jumping sealing process of FIGS. 2*a*–2*e*.

Like reference symbols are employed in the drawings and in the description of the preferred embodiments to represent the same, or very similar, item or items.

DESCRIPTION OF THE PREFERRED EMBODIMENTS

Figure 1A:
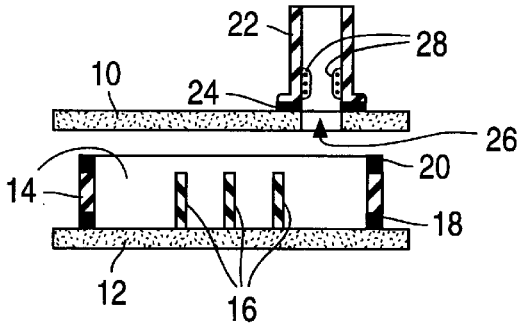
Fig. 1a PRIOR ART
FIGS. 1*a*–1*d* are cross-sectional views representing steps in a conventional process for sealing a flat-panel CRT display.
Figure 1B:
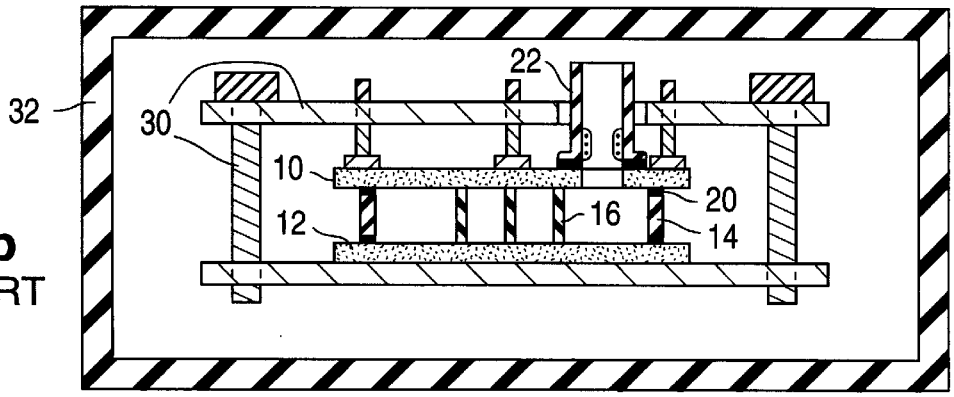
Fig. 1b PRIOR ART
Figure 1C:
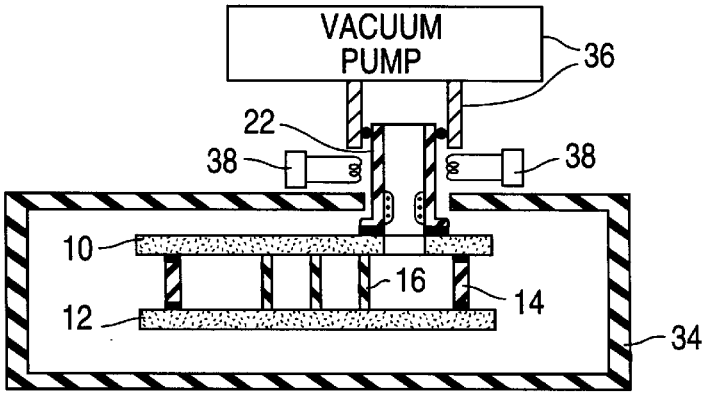
Fig. 1c PRIOR ART
Figure 1D:
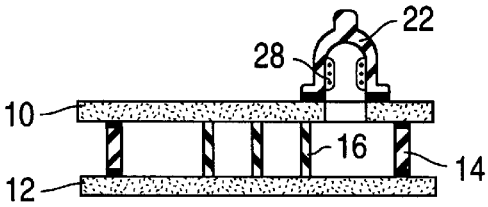
Fig. 1d PRIOR ART
Figure 2A:
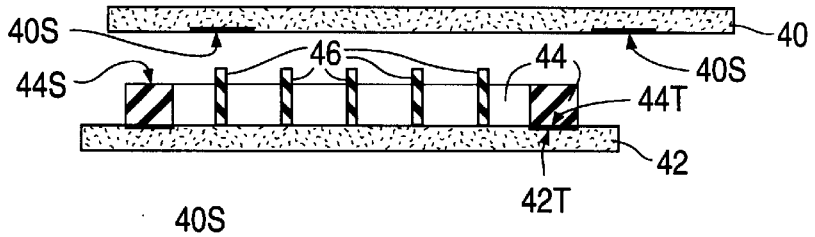
FIGS. 2*a*–2*e* are cross-sectional views representing steps in a process for sealing a flat-panel display using local energy transfer to produce gap jumping in accordance with the invention. As part of the sealing process of FIGS. 2*a*–2*e*, local energy transfer is employed to produce gap jumping to tack the flat-panel display according to the invention.
Figure 2B:
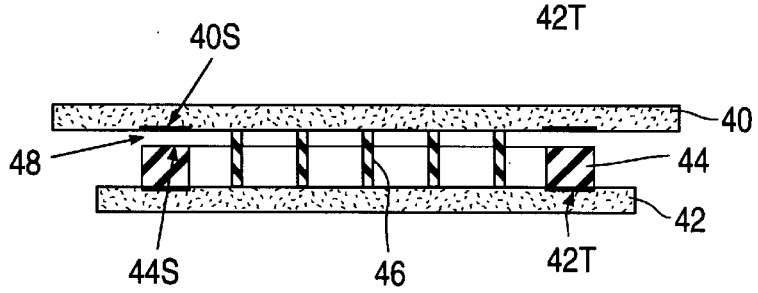
Figure 2C:
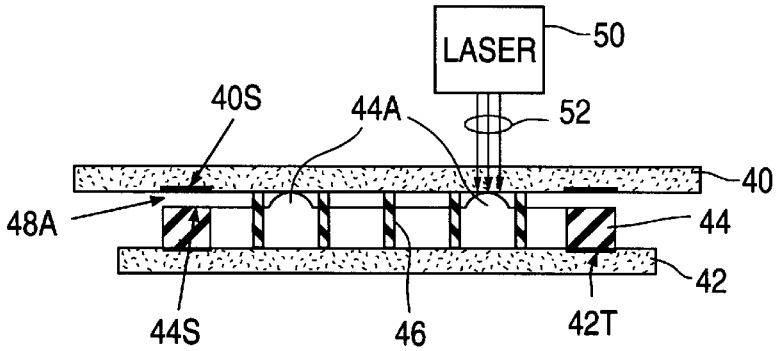

FIGS. 2*a*–2*e* (collectively "FIG. 2") illustrate a general technique for hermetically sealing a flat-panel display according to the teachings of the invention. The technique illustrated in FIG. 2 utilizes local energy transfer to produce gap jumping that causes separate portions of the flat-panel display to be sealed to one another. FIGS. 2*b and 2*c, which are dealt with below after describing the process of FIG. 2, illustrate additional steps that can be employed in the process of FIG. 2. FIGS. 2*c*' and 2*d*', likewise dealt with after describing the process of FIG. 2, present an alternative to the steps of FIGS. 2*c* and 2*d*. FIG. 3 presents a perspective view of the flat-panel display at the initial step of FIG. 2*a* in the sealing process.

As used here, the "exterior" surface of a faceplate structure in a flat-panel display is the surface on which the display's image is visible to a viewer. The opposite side of the faceplate structure is referred to as its "interior" surface even though part of the interior surface of the faceplate structure is normally outside the enclosure formed by sealing the faceplate structure to a baseplate structure through an outer wall. Likewise, the surface of the baseplate structure situated opposite the interior surface of the faceplate structure is referred to as the "interior" surface of the baseplate structure even though part of the interior surface of the baseplate structure is normally outside the sealed enclosure formed with the faceplate structure, the baseplate structure, and the outer wall. The side of the baseplate structure opposite to its interior surface is referred to as the "exterior" surface of the baseplate structure.

With the foregoing in mind, the components of the flat-panel display sealed according to the process of FIG. 2 are a baseplate structure (or body) 40, a faceplate structure (or body) 42, an outer wall 44, and a group of spacer walls 46. Baseplate structure 40 and faceplate structure 42 are generally rectangular in shape. The internal constituency of plate structures 40 and 42 is not shown. However, baseplate structure 40 consists of a baseplate and one or more layers formed over the interior surface of the baseplate. Faceplate structure 42 consists of a transparent faceplate and one or more layers formed over the interior surface of the faceplate. Outer wall 44 consists of four sub-walls arranged in a rectangle. Spacer walls 46 maintain a constant spacing between plate structures 40 and 42 in the sealed display, and enable the display to withstand external forces such as air pressure.

As described below, baseplate structure 40 is hermetically sealed to faceplate structure 42 through outer wall 44. The sealing operation normally involves raising the components of the flat-panel display to elevated temperature. To reduce the likelihood of cracking the flat-panel display, especially during cool-down to room temperature, outer wall 44 is typically chosen to consist of material having a coefficient of thermal expansion ("CTE") that approximately matches the CTEs of the baseplate and the faceplate.

A flat-panel display sealed according to the process of FIG. 2 can be anyone of a number of different types of flat-panel displays such as CRT displays, plasma displays, vacuum fluorescent displays, and liquid-crystal displays. In the flat-panel CRT display example, baseplate structure 40 contains a two-dimensional array of pixels of electron-emissive elements provided over the baseplate. The electron-emissive elements form a field-emission cathode.

Specifically, baseplate structure 40 in a flat-panel CRT display of the field-emission type typically has a group of emitter row electrodes that extend across the baseplate in a row direction. An inter-electrode dielectric layer overlays the emitter electrodes and contacts the baseplate in the space between the emitter electrodes. At each pixel location in baseplate structure 40, a large number of openings extend through the inter-electrode dielectric layer down to a corresponding one of the emitter electrodes. Electron-emissive elements, typically in the shape of cones or filaments, are situated in each opening in the inter-electrode dielectric.

A patterned gate layer is situated on the inter-electrode dielectric. Each electron-emissive element is exposed through a corresponding opening in the gate layer. A group of column electrodes, either created from the patterned gate layer or created from a separate column-electrode layer that contacts the gate layer, extend over the inter-electrode dielectric in a column direction perpendicular to the row direction. The emission of electrons from the pixel at the intersection of each row electrode and each column electrode is controlled by applying appropriate voltages to the row and column electrodes.

Faceplate structure 42 in the flat-panel field-emission display (again, "FED") contains a two-dimensional array of phosphor pixels formed over the interior surface of the transparent faceplate. An anode, or collector electrode, is situated adjacent to the phosphors in structure 42. The anode may be situated over the phosphors, and thus is separated from the faceplate by the phosphors. In this case, the anode typically consists of a thin layer of electrically conductive light-reflective material, such as aluminum, through which the emitted electrons can readily pass to strike the phosphors. The light-reflective layer increases the display brightness by redirecting some of the rear-directed light back towards the faceplate. U.S. Pat. Nos. 5,424,605 and 5,477,105 describe examples of FEDs having faceplate structure 42 arranged in the preceding manner. Alternatively, the anode can be formed with a thin layer of electrically conductive transparent material, such as indium tin oxide, situated between the faceplate and the phosphors.

When the FED is arranged in either of the preceding ways, application of appropriate voltages to the row and column electrodes in baseplate structure 40 causes electrons to be extracted from the electrone-missive elements at selected pixels. The anode, to which a suitably high voltage is applied, draws the extracted electrons towards phosphors in corresponding pixels of faceplate structure 42. As the electrons strike the phosphors, they emit light visible on the exterior surface of the faceplate to form a desired image. For color operation, each phosphor pixel contains three phosphor sub-pixels that respectively emit blue, red, and green light upon being struck by electrons emitted from electron-emissive elements in corresponding sub-pixels formed over the baseplate.

The thickness of outer wall 44 is in the range of 1–4 mm. Although the dimensions have been adjusted in FIGS. 2 and 3 to facilitate illustration of the components of the flat-panel display, the height of outer wall 44 is usually of the same order of magnitude as the outer wall thickness. For example, the outer wall height is typically 1–1.5 mm.

The four sub-walls of outer wall 44 can be formed individually and later joined to one another directly or through four corner pieces. The four sub-walls can also be a single piece of appropriately shaped material. Outer wall 44 normally consists of frit, such as Ferro 2004 frit combined with filler and a stain, arranged in a rectangular annulus as indicated in FIG. 3. The frit in outer wall 44 melts at temperature in the range of 400°–500° C. The frit melting temperature is much less, typically 100° C. less, than the melting, temperature of any of the materials of plate structures 40 and 42 and spacer walls 46.

At the initial stage shown in FIGS. 2*a* and 3, outer wall 44 has been sealed (or joined) to faceplate structure 42 along (a) an annular rectangular sealing area formed by the lower edge 44T of outer wall 44 and (b) a matching annular rectangular sealing area 42T along the interior surface of faceplate structure 42. Faceplate sealing area 42T is indicated by dark line in FIG. 2. However, this is only for illustrative purposes. Faceplate structure 42 typically does not have a feature that expressly identifies the location of sealing area 42T.

In sealing outer wall 44 to faceplate structure 42, components 42 and 44 are first placed in a suitable position relative to one another with lower wall edge 44T aligned to faceplate sealing area 42T. The alignment is performed with a suitable alignment fixture. Lower wall edge 44T normally comes into contact with faceplate sealing area 42T during the positioning step.

The sealing of outer wall 44 to faceplate structure 42 can be done in a number of ways after the alignment is complete. Normally, the sealing of wall 44 to structure 42 is performed under non-vacuum conditions at a pressure close to room pressure, typically in an environment of dry nitrogen or an inert gas such as argon.

The faceplate-structure-to-outer-wall seal can be effected in a sealing oven by raising faceplate structure 42 and outer wall 44 to a suitable sealing temperature to produce the seal and then cooling the structure down to room temperature. The temperature ramp-up and ramp-down during the global heating operation in the sealing oven each typically take 3 hr. The faceplate-structure-to-outer-wall sealing temperature, typically in the vicinity of 400°–550° C., equals or slightly exceeds the melting temperature of the frit in outer wall 44, and therefore causes the frit to be in a molten state for a brief period of time. The faceplate-structure-to-outer-wall sealing temperature is sufficiently low to avoid melting, or otherwise damaging, any part of faceplate structure 42.

Alternatively, outer wall 44 can be sealed to faceplate structure 42 with a laser after raising wall 44 and structure 42 to a bias temperature of 200°–350° C., typically 300° C. The elevated temperature during the laser seal is employed to alleviate stress along the sealing interface and reduce the likelihood of cracking.

Spacer walls 46 are mounted on the interior surface of faceplate structure 42 within outer wall 44. Spacer walls 46 are normally taller than outer wall 44. In particular, spacer walls 46 extend further away, typically an average of at least 50 $\mu$m further away, from faceplate structure 42 than outer wall 44. Although normally mounted on faceplate structure 42 after sealing outer wall 44 to structure 42, spacer walls 46 can be mounted on structure 42 before the faceplate-structure-to-outer-wall seal. In that case, the faceplate-structure-to-outer-wall sealing temperature is sufficiently low to avoid melting, or otherwise damaging, spacer walls 46.

Composite structure 42/44/46 is to be hermetically sealed to structure 40 along (a) an annular rectangular sealing area formed by the upper edge 44S of outer wall 44 and (b) an annular rectangular sealing area 40S along the interior surface of baseplate structure 40. To indicate where baseplate sealing area 40S is situated on baseplate structure 40, sealing area 40S is indicated by dark line in FIG. 2 and by dotted line in FIG. 3. As with faceplate sealing area 42T, this is only for illustrative purposes. A feature that expressly identifies the location of baseplate sealing area 40S is typically not provided on baseplate structure 40. As indicated in FIG. 3, the shape of sealing area 40S matches the shape of wall-edge sealing area 44S.

Baseplate structure 40 is transparent along at least part of, normally the large majority of, sealing area 40S. Opaque electrically conductive (normally metal) lines in baseplate structure 40 typically cross sealing area 40S. Where such crossings occur, these opaque lines are sufficiently thin that they do not significantly impact the local transfer of energy to material of outer wall 44 along edge sealing area 44S or to material of baseplate structure 40 along sealing area 40S according to the invention.

A getter (not shown) is typically situated either on the interior surface of baseplate structure 40 within sealing area 40S or on the interior surface of faceplate structure 42 within outer wall 44. As a result, the getter is located within the enclosure formed when baseplate structure 40 is sealed to composite structure 42/44/46. Alternatively, the getter may be situated in a thin auxiliary compartment mounted over the exterior surface of the baseplate and accessible to the enclosed region between plate structures 40 and 42 by way of one or more openings in the baseplate and/or, depending on the configuration of the auxiliary compartment, one or more openings in outer wall 44. In this case, the auxiliary compartment does not extend significantly above circuitry mounted over the exterior surface of the baseplate for controlling display operation, and thus does not create any significant difficulties in handing the flat-panel display.

The getter collects contaminant gases produced during, and subsequent to, the sealing of baseplate structure 40 to composite structure 42/44/46, including contaminant gases produced during operation of the hermetically sealed flat-panel display. Techniques for activating the getter are described in Pothoven et al, co-filed U.S. patent application Ser. No. 08/766,668, the contents of which are incorporated by reference to the extent not repeated herein.

Using a suitable alignment system (not shown), structures 40 and 42/44/46 are positioned relative to each other in the manner shown in FIG. 2*b*. This entails aligning sealing areas 40S and 44S (vertically in FIG. 2*b*) and bringing the interior surface of baseplate structure 40 into contact with the remote (upper in FIG. 2*b*) edges of spacer walls 46. The alignment is done optically in a non-vacuum environment, normally at room pressure, with alignment marks provided on plate structures 40 and 42. Specifically, baseplate structure 40 is optically aligned to faceplate structure 42, thereby causing baseplate sealing area 40S to be aligned to upper wall edge 44S.

In aligning structure 40 to structure 42/44/46, various techniques may be employed to ensure that spacer walls 46 stay in a fixed location relative to baseplate structure 40. For example, spacer walls 46 may go into shallow grooves (not shown) provided along the interior surface of structure 40. The grooves may extend below the general plane of the interior surface of structure 40 or may be provided in structures extending above the general plane of the interior surface of structure 40.

Regardless of how spacer walls 46 are secured to baseplate structure 40, spacer walls 46 are sufficiently taller than outer wall 44 that a gap 48 extends between aligned sealing areas 44S and 40S. At this stage of the sealing process, gap 48 normally extends along the entire (rectangular) length of sealing areas 40S and 44S. At the minimum, gap 48 extends along at least 50% of the sealing area length. The average height of gap 48 is normally in the range of 25–100 $\mu$m, typically 75 $\mu$m. The average gap height can readily be at least as much as 300 $\mu$m.

With structures 40 and 42/44/46 situated in the alignment system, a tacking operation is performed on the partially sealed flat-panel display as a preliminary step to sealing baseplate structure 40 to composite structure 42/44/46. The tacking operation serves to hold structure 40 in a fixed position relative to structure 42/44/46.

The tacking operation may be conducted in various ways. In the process of FIG. 2, the tacking operation is performed with a laser 50 that tacks structure 40 to structure 42/44/46 at several separate locations along aligned sealing areas 40S and 44S. See FIG. 2*c*. Inasmuch as the tacked portions of the flat-panel display are raised to elevated temperature during the tacking with laser 50, a global heating operation may be performed on structures 40 and 42/44/46 immediately before the laser tacking to raise structures 40 and 42/44/46 to a tacking bias temperature of 25° C.–300° C. The elevated temperature alleviates stress along the areas that are to be tacked, thereby reducing the likelihood of cracking.

Laser 50 is arranged so that its laser beam 52 passes through transparent material of baseplate structure 40 at each of the tack locations and enters corresponding upper portions of outer wall 44 while the aligned structure is in the non-vacuum environment. Light (photon) energy from beam 52 is transferred through baseplate structure 40 and locally to upper portions of outer wall 44 along sealing area 44S. This causes portions 44A of wall 44 to jump gap 48 and contact baseplate structure 40 at corresponding portions of sealing area 40S.

More particularly, outer wall 44 has corners at the edges of sealing area 44S. As the light energy of beam 52 is transferred locally to outer wall 44 at the tack locations, the portions of wall 44 immediately subjected to the light energy melt. Surface tension causes the so-melted portions of wall 44 to become round. The melted material at the corners of sealing area 44S moves towards the center of area 44S at the tack locations. In turn, this causes the material at the center of area 44S to move upward.

Gas contained in the melted portions of outer wall 44 or produced as a result of the melting may contribute to the upward expansion of wall 44 at the tack locations. Also, depending on the composition of wall 44 and on the conditions (e.g., wall temperature along sealing area 44S) of the local energy transfer, the material of wall 44 along edge 44S may undergo a phase change in which the density of that material decreases. The attendant increase in volume of the material of wall 44 along sealing area 44S then causes that material to expand toward sealing area 40S. In any event, upward-protruding portions 44A at the tack locations meet baseplate structure 40. After laser beam 52 moves beyond each upward-protruding tack portion 44A, that tack portion 44A cools down and becomes hard.

Laser 50 can be implemented with any of a number of different types of lasers provided that laser beam 52 has a major wavelength at which the material of outer wall 44 along sealing area 44S absorbs the light energy of beam 52 generated at that wavelength while the transparent material of baseplate structure 40 along sealing area 40S does not significantly absorb any of the light energy of beam 52 generated at that wavelength. For the case in which outer wall 44 is formed with frit such as the Ferro 2004 frit composite described above, the material of wall 44 along sealing area 44S absorbs light in the wavelength band extending from less than 0.2 $\mu$m to greater than 10 $\mu$m. This covers the entire visible light region running from 0.38 $\mu$m to 0.78 $\mu$m.

When the transparent material of structure 40 along sealing area 40S consists of glass, such as Schott D263 glass, that strongly transmits light whose wavelength is in the band extending from approximately 0.3 $\mu$m in the ultraviolet ("UV") region to approximately 2.5 $\mu$m in the infrared region, beam 52 has a major wavelength in the approximate range of 0.3–2.5 $\mu$m. As used here in connection with light transmission, "strongly" means at least 90% transmission. Subject to the preceding limitation, laser 50 can be a semiconductor diode laser, a carbon dioxide laser (with beam 52 offset by 90°), a UV laser, or a neodymium YAG laser. For example, when laser 50 is a diode laser, the beam wavelength is typically 0.85 $\mu$m. The power of beam 52 is typically 2–5 w.

Upward-protruding tack portions 44A firmly connect baseplate structure 40 to composite structure 42/44/46. Due to the formation of tack portions 44A, gap 48 is partially closed. Item 48A in FIG. 2c indicates the remainder of gap 48 after all of tack portions 44A have been produced. This completes the partial sealing of structure 40 to structure 42/44/46, subject to cooling the tacked display down to room temperature if a global heating operation was performed earlier on structures 40 and 42/44/46 to relieve stress during the laser tacking.

Figure 2D:
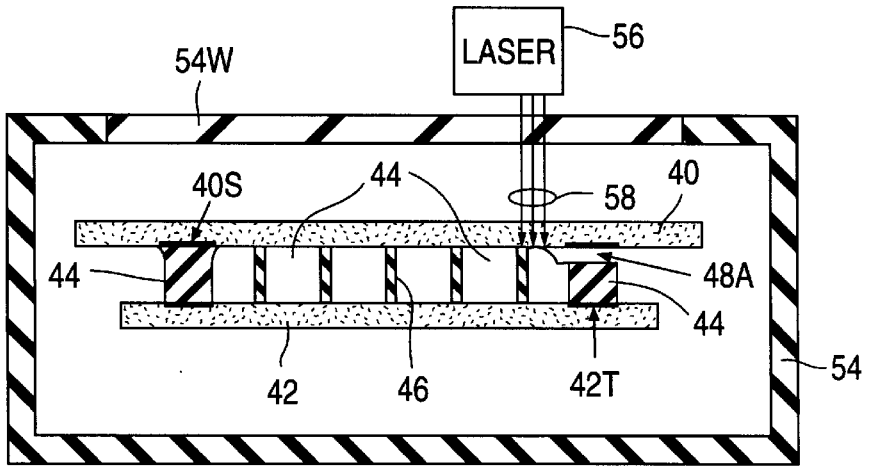
Figure 3:
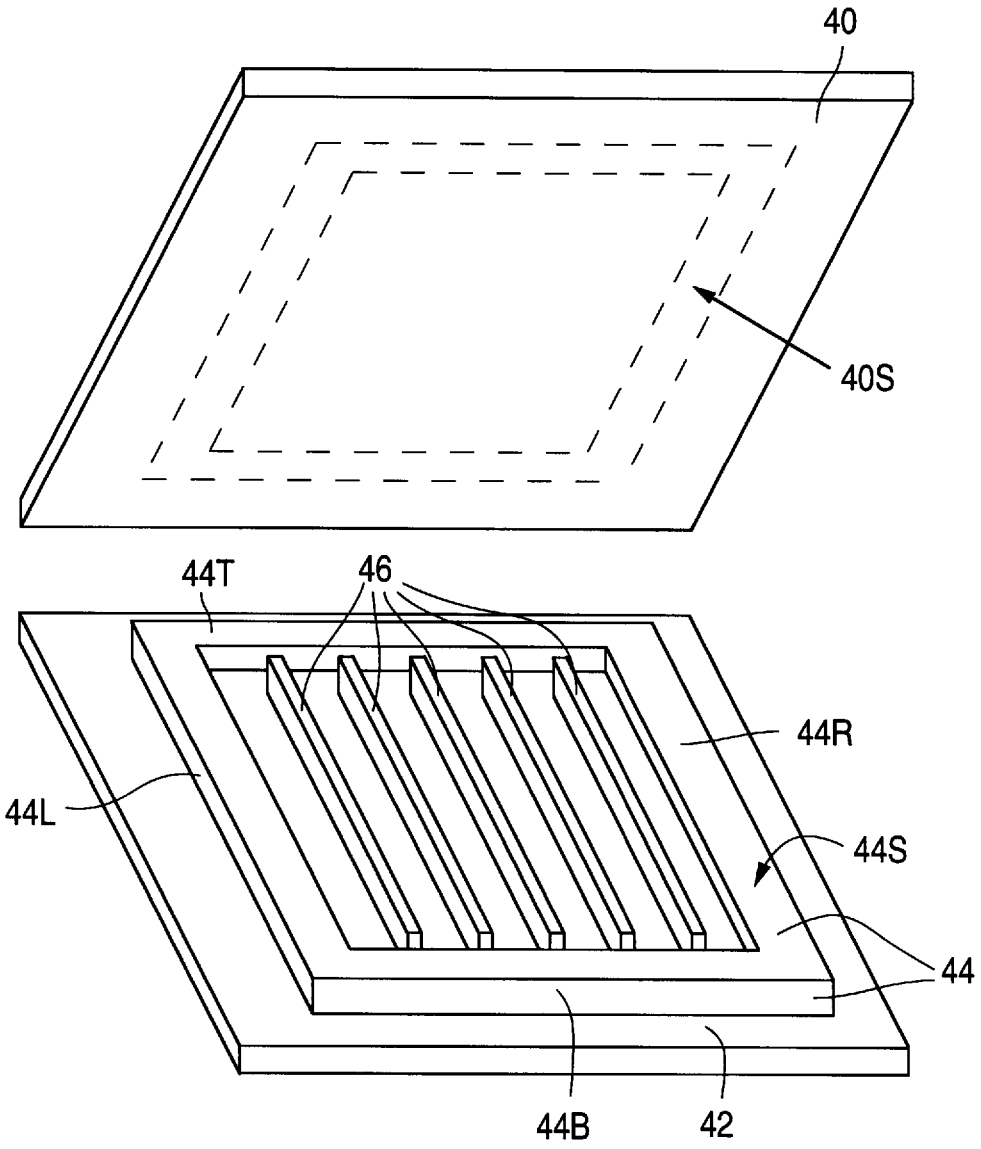
FIG. 3 is a perspective view of the flat-panel display of FIG. 2*a*.

The tacked/partially sealed flat-panel display is removed from the alignment system and placed in a vacuum chamber 54, as shown in FIG. 2*d*, for performing operations to complete the hermetic seal. Vacuum chamber 54 is then pumped down to a high vacuum level at a pressure no greater than $10^{-2}$ torr, typically $10^{-6}$ torr or lower. After optionally activating the (unshown) getter, the temperature of the flat-panel display is raised to a bias temperature of 200°–350° C., typically 300° C. The temperature ramp-up is usually performed in an approximately linear manner at a ramp-up rate in the vicinity of 3°–5° C./min. The elevated temperature reduces the likelihood of display cracking by alleviating stress in the material along sealing areas 40S and 44S.

The components of the tacked flat-panel display outgas during the temperature ramp-up and during the subsequent "soak" time at the bias temperature prior to display sealing. The gases, typically undesirable, that were trapped in the display structure enter the unoccupied part of vacuum chamber 54, causing its pressure to rise. To remove these gases from the enclosure that will be produced when baseplate structure 40 is fully sealed to composite structure 42/44/46, the vacuum pumping of chamber 54 is continued during the sealing operation in chamber 54. If activated, the (unshown) getter contained in the partially completed enclosure assists in collecting undesired gases during the temperature ramp-up and subsequent soak.

A laser 56 that produces a laser beam 58 is located outside vacuum chamber 54. Laser 56 is arranged so that beam 58 can pass through a (transparent) window 54W of chamber 54 and then through transparent material of baseplate structure 40. Window 54W typically consists of quartz.

Laser 56 can be any of a number of different types of lasers provided that laser beam 58 has a major wavelength at which neither window 54W in vacuum chamber 54 nor the transparent material of baseplate structure 40 along sealing area 40S significantly absorbs any of the light energy of beam 58 moving at that wavelength. Quartz, typically used for window 54W, strongly transmits light whose wavelength is in the band extending from 0.2 $\mu$m to nearly 3 $\mu$m. When the transparent material of baseplate structure 40 along sealing area 40S consists of glass that strongly transmits light in the wavelength band from approximately 0.3 $\mu$m to approximately 2.5 $\mu$m, the glass transmission band is included within the quartz transmission band. Since beam 58 must pass through both quartz and glass in this example, beam 58 has a major wavelength in the approximate range of 0.3–2.5 $\mu$m, just as with beam 52 of laser 50 used in the tacking operation. According, laser 56 can be any of the laser types described above for laser 50. In a typical case where laser 56 is a diode laser, beam 58 has a major wavelength of 0.85 $\mu$m. The power of beam 58 is typically 2–5 w.

With the pressure of vacuum chamber 56 at a high vacuum level and with the partially sealed flat-panel display at a bias temperature in the above-mentioned range, laser beam 58 and the display are moved relative to each other in such a way that beam 58 substantially fully traverses aligned sealing areas 40S and 44S. That is, beam 58 starts at one place along sealing areas 40S and 44S, and (relative to the display) moves from that place in a rectangular pattern until reaching the original place. FIG. 2*d* illustrates how the flat-panel display appears at an intermediate point during the traversal of beam 58 along sealing areas 40S and 44S. Laser beam 58 typically moves at rate in the vicinity of 1 mm/sec relative to the display. If desired, beam 58 can skip tack portions 44A.

As laser beam 58 traverses sealing areas 40S and 44S, light energy is transferred through baseplate structure 40 and locally to upper material of outer wall 44 along gap remainder 48A. The local energy transfer causes the material of outer wall 44 subjected to the light energy to melt and jump remaining gap 48A. The gap-jumping mechanism here is basically the same as the gap-jumping mechanism that occurred during the earlier gap-jumping tack operation. The melted wall material along sealing area 44S hardens after beam 58 passes.

Gap remainder 48A progressively closes during the sealing operation with laser 56. As remaining gap 48A closes, the gases present in the enclosure being formed by the sealing of outer wall 44 to baseplate structure 40 escape from the enclosure through the progressively decreasing remainder of gap 48A. Full closure of gap remainder 48A occurs when beam 58 completes the rectangular traversal of sealing areas 40S and 44S.

After the sealing operation with laser 56 is complete and while the sealed flat-panel display is approximately at the bias temperature, the (unshown) getter is activated (re-activated if activated prior to the sealing operation). The temperature of the display is then returned to room temperature. The term "room temperature" here means the external (usually indoor) atmospheric temperature, typically in the vicinity of 20°–25° C.

The cool down to room temperature is controlled so as to avoid having the instantaneous cool-down rate exceed a value in the range of 3°–5° C./min. Inasmuch as the natural cool-down rate at the beginning of the thermal cool-down cycle normally exceeds 3°–5° C./min., heat is applied during the initial part of the cycle to maintain the cool-down rate approximately at the selected value in the range of 3°–5° C./min. The heating is progressively decreased until a temperature is reached at which the natural cool-down rate is approximately at the selected value after which the flat-panel display is typically permitted to cool down naturally at a rate that progressively decreases to zero. Alternatively, a forced cool down can be employed during this part of the cool-down cycle to speed up the cool down.

Figure 2E:
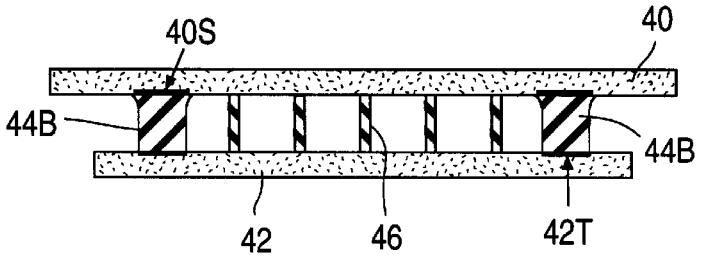
Figure 2B:
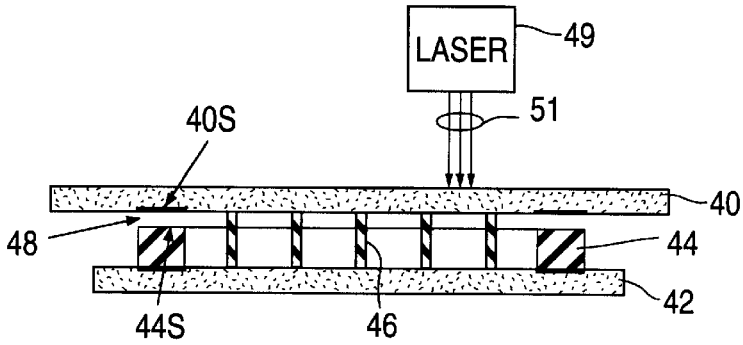
Figure 2C:
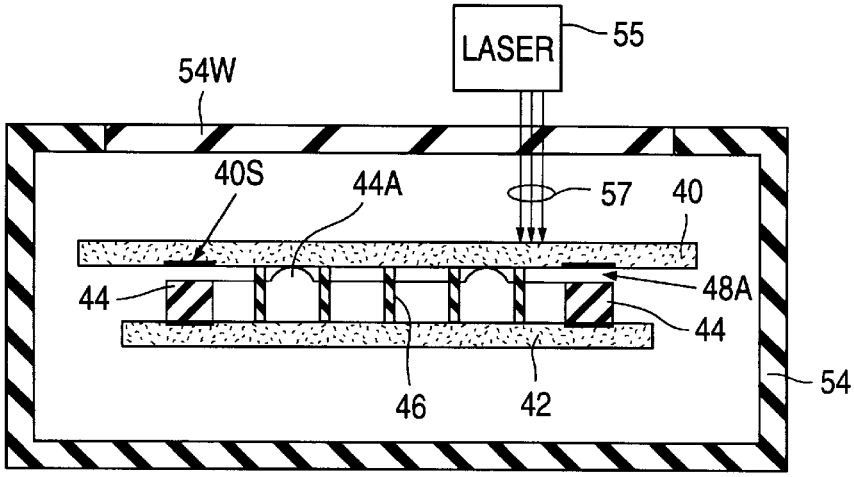
Figure 2C:
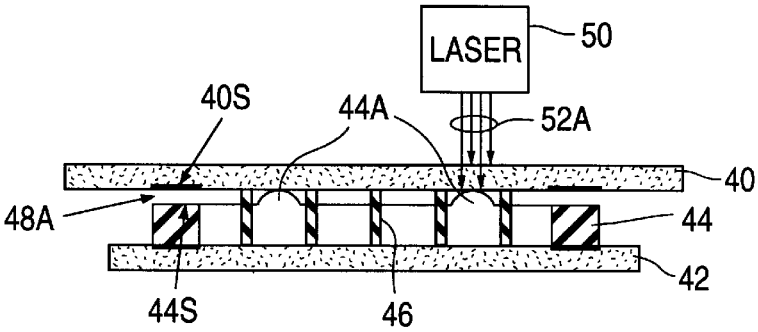
Figure 2D:
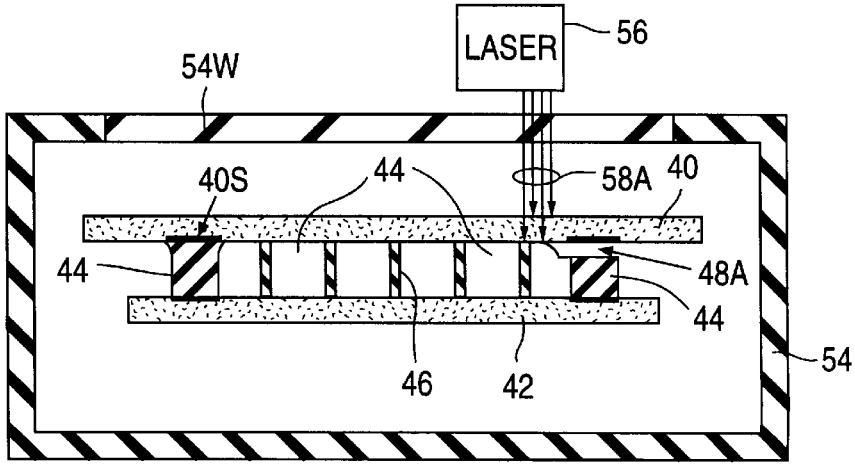

The chamber pressure is subsequently raised to room pressure, and the fully sealed flat-panel display is removed from vacuum chamber 54. The term "room pressure" here means the external atmospheric pressure, normally in the vicinity of 1 atm. depending on the altitude. Alternatively, the chamber pressure can be raised to room pressure before cooling the sealed display down to room temperature. In either case, FIG. 2*e* illustrates the resulting structure. Item 44B in the sealed flat-panel display indicates the sealed shape of outer wall 44.

The getter is re-activated after the sealed flat-panel display is returned to room temperature. The getter re-activation can be performed while the display is in vacuum chamber 54 or after removing the display from chamber 54.

As part of the laser tacking and final gap jumping laser sealing operations, the material of baseplate structure 40 along sealing area 40S can be locally heated to a temperature close to the melting temperature of the material of outer wall 44 along edge sealing area 44S. The baseplate structure material along sealing area 40S normally has a considerably higher melting temperature than the outer wall material along sealing area 44S and thus does not melt, or closely approach melting, during such heating. For example, when the outer wall material along sealing area 44S melts at 400°–500° C. and the baseplate structure material along sealing area 40S melts at 700° C., the baseplate structure material along sealing area 44S can be safely locally raised to approximately the melting temperature of the outer wall material along sealing area 44S. Doing so provides stress relief in the sealed material along the interface between baseplate structure 40 and outer wall 44.

Raising the material of baseplate structure 40 along sealing area 40S to a temperature close to the melting temperature of the material of outer wall 44 along sealing area 44S is normally performed when the flat-panel display is already at the desired bias temperature of 200°–350° C. Consequently, stress is relieved in the entire display at a temperature high enough to cause outgassing of gases that might otherwise outgas into the finally sealed enclosure during display operation and cause display degradation without the necessity for expending the large amount of time that would be involved in raising the entire display to the considerably higher melting temperature of outer wall 44.

Some additional outgassing does occur from the baseplate structure material along sealing area 40S when that material is raised to the melting temperature of the outer wall material along edge sealing area 44S. However, the combination of heating the entire display to a bias temperature of 200°–350° C. and then locally raising the baseplate structure material along sealing area 40S to the higher melting temperature of the outer wall material avoids raising other parts of the display to a high temperature that could cause unnecessary outgassing from those other parts of the display and could damage active elements in the display. The combination of globally heating the entire display to a moderately high bias temperature and locally heating the baseplate structure material along sealing area 40S to a higher temperature close to the melting temperature of the outer wall material along sealing area 44S is thus highly beneficial.

FIGS. 2*b and 2*c illustrate a technique for locally heating the material of baseplate structure 40 along sealing area 40S to a temperature close to the melting temperature of the material of outer wall 44 along sealing area 44S. After the positioning step of FIG. 2*b* is completed but before upward-protruding tack portions 44A are created by laser 50 in FIG. 2*c*, a laser 49 is employed to transfer light energy locally to portions of the baseplate structure material along sealing area 40S opposite the intended locations for tack portions 44A as indicated in FIG. 2*b. Laser 49 generates a laser beam 51 that raises these portions of the baseplate structure material to a selected tacking-assist temperature close to the melting temperature of the outer wall material along sealing area 44S. The tacking-assist temperature typically is lower than the melting temperature of the outer wall material along sealing area 44S. For simplicity, laser 49 may also be operated to raise the remainder of the baseplate structure material along sealing area 40S** to the tacking-assist temperature.

Laser beam 51 has a major wavelength outside the transmission band of the transparent material of baseplate structure 40 along sealing area 40S. For example, when outer wall 44 consists of frit that absorbs light whose wavelength is in the band running from less than 0.2 μm to greater than 10 μm while the transparent material of baseplate structure 40 along sealing area 40S consists of glass that strongly transmits light in the wavelength band running approximately from 0.3 μm to 2.5 μm, laser beam 51 has a major wavelength in the lower domain running from less than 0.2 μm to approximately 0.3 μm or in the upper domain running from approximately 2.5 μm to greater than 10 μm. In addition, beam 51 does not have any major wavelength within the transmission band of the transparent material of baseplate structure 40 along sealing area 40S—i.e., not in the approximate 0.3-μm-to-2.5-μm wavelength band when the transparent baseplate structure material along sealing area 40S consists of glass such as Schott D263 glass.

After the laser tacking step of FIG. 2*c* has been completed and the tacked flat-panel display has been placed in vacuum chamber 54 but before gap remainder 48A has been bridged by local energy transfer from laser 56 in FIG. 2*d*, a laser 55 is utilized to transfer light energy locally through window 54W of chamber 54 to portions of the material of baseplate structure 40 along sealing area 40S as shown in FIG. 2*c*. Laser 55 generates a laser beam 57 that raises the baseplate structure material along sealing area 40S to a selected sealing-assist temperature close to the melting temperature of the outer wall material. The sealing-assist temperature typically is approximately equal to the melting temperature of the outer wall material along sealing area 44S. As with laser beam 58 of laser 56, laser beam 57 passes through chamber window 54W without significant absorption. Likewise, laser 55 may be operated so that beam 57 skips the portions of the baseplate structure material opposite tack portions 44A.

Laser beam 57 has a major wavelength within the transmission band of chamber window 54W but outside the transmission band of the transparent material of baseplate structure 40 along sealing area 44S. For example, when outer wall 44 consists of frit that absorbs light in the 0.2-μm-to-10-μm wavelength band while window 54W consists of quartz that strongly transmits light whose wavelength is in the band extending approximately from 0.2 μm to 3 μm, and the transparent material of baseplate structure 40 along sealing area 40S consists of glass that strongly transmits light in the approximate 0.3-μm-to-2.5-μm wavelength band, beam 57 has a major wavelength in the approximate lower domain of 0.2–0.3 μm or in the approximate upper domain of 2.5–3 μm.

If the preceding wavelength domains for laser beam 57 are unduly narrow, the quartz typically used for window 54W can be replaced with transparent material, such as zinc selenide, that strongly transmits light whose wavelength extends from approximately 0.2 μm to greater than 10 μm. Beam 57 can then have a major wavelength in the approximate upper domain running from 2.5 μm to greater than 10 μm. As with laser beam 51, beam 57 normally does not have a major wavelength within the transmission band of the transparent material of baseplate structure 40 along sealing area 40S—i.e., not in the approximate 0.3-μm-to-2.5-μm wavelength band when the transparent material of baseplate structure 40 along sealing area 40S is formed with glass such as Schott D263 glass.

Lasers 49 and 55 can be replaced with focused lamps that provide light in wavelength bands that fall into specified wavelength domains but do not provide light in wavelength bands outside the specified domains. For example, when window 54W consists of quartz while the materials of baseplate structure 40 and outer wall 44 along sealing areas 40S and 44S have the exemplary transmission/absorption characteristics given above, laser 49 can be replaced with a focused lamp that transmits light across a wavelength band falling into the lower wavelength domain from less than 0.2 μm to approximately 0.3 μand/or the upper wavelength domain from approximately 2.5 μm to greater than 10 μm. Laser 55 can then be replaced with a focused lamp that transmits light in a wavelength band falling into the lower wavelength domain of 0.2–0.3 μm or into the approximate upper wavelength domain of 2.5–3 μm. If window 54 is formed with zinc selenide rather than quartz, the upper domain for the wavelength band of the focused lamp that replaces laser 55 is approximately 2.5–10 μm. Filters that strongly attenuate wavelengths (frequencies) in selected bands can be employed on the focused lamps to remove light in undesired wavelength bands if the focused lamps do not already do so naturally.

FIGS. 2*c*' and 2*d*' illustrate another technique for locally heating material of baseplate structure 40 along sealing area 40S to a temperature close to the melting temperature of the material of outer wall 44 along edge sealing area 44S. The difference between the technique of FIGS. 2*c*' and 2*d*' and the technique of FIGS. 2*b and 2*c in which the local heatings of the baseplate structure material along sealing area 40S are performed respectively before utilizing lasers 50 and 56 to locally heat the material of outer wall 44 along sealing area 44S is that the local heatings of the baseplate structure material along sealing area 40S in the technique of FIGS. 2*c*' and 2*d*' are performed respectively at the same times that lasers 50 and 56 are employed to locally heat the outer wall material along sealing area 44S. In the process of FIG. 2, the step of FIGS. 2*c*' thus replaces the step of FIG. 2*c*, while the step of 2*d*' similarly replaces the step of FIG. 2*d*.

Laser 50, used in the tacking operation, generates a laser beam 52A at wavelengths falling into two or more distinct tacking wavelength domains. See FIG. 2*c*'. The energy of beam 52A in one of these tacking wavelength domains locally raises the temperature of the portions of the baseplate structure material along sealing area 40S opposite the intended locations for tack portions 44A to a selected tacking-assist temperature close to the melting temperature of the outer wall material along sealing area 44S. The tacking-assist temperature again typically is lower than the melting temperature of the outer wall material along sealing area 44S.

At the same time that the beam energy in this tacking wavelength domain raises portions of baseplate structure 40 along sealing area 40S to the tacking-assist temperature, the energy of laser beam 50A in another of the wavelength domains is locally transferred to portions of the outer wall material along sealing area 44S to cause gap jumping that produces tack portions 44A. The amount of light energy locally transferred to the baseplate structure material at the intended tack locations relative to the amount of light energy simultaneously locally transferred to the outer wall material at the tack locations is controlled by suitably choosing the wavelength domains, including the power provided in those wavelength domains, for beam 52A relative to the composition of the materials of baseplate structure 40 and outer wall 44 at the tack locations. In this way, the value of the tacking-assist temperature is controlled relative to the melting temperature of the outer wall material along edge 44S.

Consider the exemplary display values given above in which outer wall 44 consists of frit that absorbs light energy in the wavelength band running from less than 0.2 μm to greater than 10 μm while the baseplate structure material along sealing area 44S consists of glass that transmits light in the domain running approximately from 0.3 μm to 2.5 μm. In this case, laser beam 52A has (a) a first major wavelength in the approximate domain of 0.3–2.5 μm for local heating portions of the outer wall material to produce tack portions 44A and (b) another major wavelength in the lower domain extending from less than 0.2 μm to approximately 0.3 μm or in the upper domain extending from approximately 2.5 μm to greater than 10 μm for heating the portions of the baseplate structure material opposite tack portions 44A to the tacking-assist temperature. These tacking wavelength domains are distinct even though they share boundaries.

Laser 56, employed in the final gap jumping laser seal while the tacked flat-panel display is in vacuum chamber 54, generates a laser beam 58A at wavelengths that fall into two or more distinct sealing wavelength domains bounded by the ends of the wavelength transmission band of chamber window 54W. The energy of laser beam 58A in one of these sealing wavelength domains locally raises the temperature of the baseplate structure material along sealing area 40S to a selected sealing-assist temperature close to the melting temperature of the outer wall material along sealing area 44S. The sealing-assist temperature again typically is approximately equal to the melting temperature of the outer wall material along sealing area 44S.

At the same time that the beam energy in this wavelength domain locally raises the baseplate structure material along sealing area 44S to the sealing-assist temperature, the energy of laser beam 58A in another of the selected wavelength domains is locally transferred to the outer wall material along sealing area 44S to produce gap jumping that fully closes gap remainder 48A. As in the tacking operation of FIG. 2*c*', the amount of light energy locally transferred to the baseplate structure material along sealing area 40S relative to the amount of light energy locally transferred to the outer wall material along sealing area 44S is controlled by suitably choosing the wavelength domains, including the power provided in those wavelength domains, for beam 58A relative to the compositions of the materials of baseplate structure 40 and outer wall 44 along gap remainder 48A. This enables the value of the sealing-assist temperature to be controlled relative to the melting temperature of the outer wall material along edge 44S. Laser 56 may be operated so as to skip tack portions 44A and the portions of baseplate structure 40 opposite portions 44A.

Consider the exemplary display/chamber-window values given above in which chamber window 54W is formed with quartz that strongly transmits light in the wavelength band running approximately from 0.2 μm to 3 μm while outer wall 44 is formed with frit that absorbs light in at least the 0.2-μm-to-10-μm wavelength band, and the material of baseplate structure along sealing area 44S is formed with glass that strongly transmits light in the approximate 0.3-μm-to-2.5-μm wavelength band. Laser beam 58A then has one major wavelength in the approximate domain of 0.3–2.5 μm for locally heating the outer wall material along sealing area 44S to close gap 48A by gap jumping and (b) another major wavelength in the lower domain extending approximately from 0.2 μm to 0.3 μm or in the upper domain extending approximately from 2.5 μm to 3 μm for heating the baseplate structure material along sealing area 40S to the sealing-assist temperature.

If the preceding wavelength domains for heating the baseplate structure material along sealing area 44S to the sealing-assist temperature are unduly narrow, the quartz typically used in chamber window 54W can again be replaced with transparent material, such as zinc selenide, that strongly transmits light at least in the 0.2-μm-to-10-μm wavelength band. The upper wavelength domain for heating the baseplate structure material along sealing area 44S to the sealing-assist temperature can then be extended to 2.5–10 μm.

Laser 50 can be replaced with a focused lamp that generates light in wavelength bands that fall into the tacking wavelength domains given above for the step of FIG. 2*c*'. Laser 56 can likewise be replaced with a focused lamp that generates light in wavelength bands that fall into the sealing wavelength domains given above for the step of FIG. 2*d*'. Wavelength (frequency) filters can again be utilized on the focused lamps to remove light in undesired wavelength bands.

While the invention has been described with reference to particular embodiments, this is solely for the purpose of illustration and is not to be construed as limiting the scope of the invention claimed below. For example, the local energy transfer that causes gap jumping in the process of FIG. 2 can be implemented with light energy other than laser-produced light energy. Although gap jumping is typically performed only at the interface between outer wall 44 and one of plate structures 40 and 42, gap jumping can be performed at both the baseplate structure/outer wall interface and the faceplate structure/outer wall interface.

Material of baseplate structure 40 along sealing area 40S could move part of the way toward outer wall 44 so as to help bridge gap 48 or 48A. A tacking structure, such as a group of tack posts, situated outside outer wall 44 could be used in place of laser-produced tack portions 44A to hold structures 40 and 42/44/46 in a fixed position relative to each other.

By using gap jumping to close gap 48 or 48A while the flat-panel display is in a vacuum environment, the need for pump-out tubulation is eliminated. Nonetheless, the final gap jumping could be performed in an environment where the pressure is above a vacuum level of $10^{-2}$ torr. For instance, the gap jumping to close gap 48 or 48A can be performed in a neutral environment at a pressure close to room pressure. The gap jumping to close gap 48 or 48A can also be performed in a neutral environment at a pressure below room pressure but considerably above the vacuum level. Several torr is an example.

The neutral environment in the preceding examples is typically formed with dry nitrogen. Use of a nitrogen environment to perform the final gap jumping seal takes advantage of the fact that frit, the material typically used in outer wall 44, sealed in dry nitrogen normally has lower porosity, and thus higher density, than otherwise identical frit sealed in a high vacuum. Hence, the portion of the frit in outer wall 44 sealed to baseplate structure 40 in dry nitrogen is less likely to develop leaks. The overall hermeticity of the sealed flat-panel display is improved. Similar advantages are achieved when the neutral environment is formed with an inert gas such as argon.

Inasmuch as the pressure in the flat-panel display is above a high vacuum level at the end of the sealing operation when the gap jumping is performed in a neutral environment at a pressure above vacuum, a pump-out tube is typically utilized to reduce the pressure in the display to a high vacuum level no greater than $10^{-2}$ torr, typically $10^{-6}$ torr or lower, after which the pump-out tube is closed. The presence of the pump-out tube is thus exchanged for improved hermeticity.

Outer wall 44 can have a shape other than a rectangular annulus. Materials in addition to frit can be used in outer wall 44. For instance, outer wall 44 can consist of glass or ceramic along the central portion of wall 44. Frit can then be provided at the top and bottom of wall 44 for achieving hermetic sealing according to the invention.

The invention can be employed to hermetically seal flat-panel devices other than displays. Examples include (a) microchannel plates in high-vacuum cells similar to photo multipliers, (b) micromechanical packages for devices such as accelerometers, gyroscopes, and pressure sensors, and (c) packages for biomedical implants. Various modifications and applications may thus be made by those skilled in the art without departing from the true scope and spirit of the invention as defined in the appended claims.

We claim:

1. A method comprising the steps of:

positioning a first edge of a primary wall near a matching sealing area of a first plate structure such that a gap at least partially separates the wall's first edge from the first plate structure's sealing area; and transferring energy locally to material of the wall along the gap to cause material of the wall and first plate structure to bridge the gap and substantially fully seal the first plate structure along its sealing area to the wall along its first edge.

2. A method as in claim 1 wherein the gap has an average height of at least 25 $\mu$m.

3. A method as in claim 1 wherein material of the wall bridges largely all of the gap.

4. A method as in claim 1 wherein the energy-transferring step at least partially entails directing light energy locally onto material of the wall along the gap.

5. A method as in claim 4 wherein the energy-transferring step is performed with a laser.

6. A method as in claim 1 wherein the energy-transferring step entails directing the energy locally through the first plate structure.

7. A method as in claim 1 further including, before the energy-transferring step, the steps of:

positioning a second edge of the wall adjacent to a matching sealing area of a second plate structure, the second edge being opposite the first edge; and sealing the second plate structure along its sealing area to the wall along its second edge.

8. A method as in claim 7 wherein the sealing areas of the plate structures and the edges of the wall are annularly shaped, whereby the plate structures and the wall form an enclosure at the end of the energy-transferring step.

9. A method as in claim 8 wherein the wall and the first plate structure are fully separated prior to the positioning step, the gap extending substantially along all of the wall's first edge and all of the first plate structure's sealing area.

10. A method as in claim 8 wherein the two plate structures and the wall are in a vacuum environment as the energy-transferring step is being completed.

11. A method as in claim 10 wherein the vacuum environment is at a pressure no greater than $10^{-2}$ torr.

12. A method as in claim 8 wherein the two plate structures and the wall are in a non-vacuum environment as the energy-transferring step is being completed.

13. A method as in claim 12 wherein the non-vacuum environment is at a pressure greater than $10^{-2}$ torr.

14. A method as in claim 12 wherein the non-vacuum environment during completion of the energy-transferring step consists primarily of at least one of nitrogen and an inert gas.

15. A method as in claim 12 wherein the non-vacuum environment is below room pressure during completion of the energy-transferring step.

16. A method as in claim 12 further including subsequent to the energy-transferring step, the step of removing gas from the enclosure to produce a vacuum at a pressure no greater than $10^{-2}$ torr in the enclosure.

17. A method as in claim 8 further including before the energy-transferring step, the step of globally heating the plate structures and the wall to raise them to a bias temperature high enough to reduce stress during the energy-transferring step but not high enough to cause any significant damage to either plate structure or the wall.

18. A method as in claim 17 wherein the bias temperature is 200° C.–350° C.

19. A method as in claim 8 wherein the two plate structures and the wall are components of a flat-panel device.

20. A method as in claim 19 wherein the flat-panel device is a flat-panel display which provides an image on one of the plate structures at its exterior surface.

21. A method as in claim 8 wherein:

one of the plate structures is a baseplate structure that includes means for emitting electrons; and the other plate structure is a faceplate structure that includes means for emitting light upon being struck by electrons emitting from the emitting means.

22. A method as in claim 1 wherein material of the wall along its first edge melts at a lower temperature than material of the first plate structure along its sealing area, further including the step of transferring energy locally to material of the first plate structure along its sealing area to raise that material to a temperature close to the melting temperature of material of the wall along its first edge.

23. A method as in claim 22 wherein the step of transferring energy locally to the wall is initiated after initiating the step of transferring energy locally to the first plate structure.

24. A method as in claim 22 wherein the two energy-transferring steps are performed simultaneously using a single source for the energy.

25. A method as in claim 22 wherein each of the energy-transferring steps is performed with a laser or a focused lamp.

26. A method as in claim 1 wherein material of the wall bridges the gap due at least partially to surface tension.

27. A method comprising the steps of:

positioning a first edge of a primary wall adjacent to a matching prescribed area of a first plate structure; and transferring energy locally to multiple spaced-apart portions of material of at least the wall along its first edge so as to tack the first plate structure to the wall at corresponding spaced-apart locations.

28. A method as in claim 27 wherein the energy-transferring step at least partially entails directing light energy locally onto the spaced-apart portions of the material of the wall along its first edge.

29. A method as in claim 28 wherein the energy-transferring step is performed with a laser.

30. A method as in claim 27 further including, after the energy-transferring step, the step of transferring energy to at least one of the first plate structure and the wall to fully seal the first plate structure along its prescribed area to the wall along its first edge.

31. A method comprising the steps of:

positioning a first edge of a primary wall near a matching prescribed area of a first plate structure such that a gap separates the wall's first edge from the first plate structure's prescribed area; and transferring energy locally to multiple spaced-apart portions of material of the wall along the gap to cause material of the wall and first plate structure to bridge corresponding spaced-apart sections of the gap, thereby tacking the first plate structure to the wall at corresponding spaced-apart locations.

32. A method as in claim 31 wherein the gap has an average height of at least 25 $\mu$m.

33. A method as in claim 31 wherein material of the wall bridges largely all of the spaced-apart sections of the gap.

34. A method as in claim 31 wherein the energy-transferring step at least partially entails directing light energy locally onto the spaced-apart portions of the material of the wall along the gap.

35. A method as in claim 34 wherein the energy-transferring step is performed with a laser.

36. A method as in claim 31 further including, after the energy-transferring step, the step of closing the remainder of the gap to seal the first plate structure along its prescribed area to the wall along its first edge.

37. A method as in claim 36 wherein the gap-remainder closing step comprises transferring energy locally to material of the wall along the gap to cause material of the wall and first plate structure to bridge and fully close the gap.

38. A method as in claim 36 further including, the steps of:

positioning a second edge of the wall adjacent to a matching prescribed area of a second plate structure, the second edge being opposite the first edge; and sealing the second plate structure along its prescribed area to the wall along its second edge.

39. A method as in claim 38 wherein the two plate structures and the wall are components of a flat-panel device.

40. A method as in claim 39 wherein the flat-panel device is a flat-panel display which provides an image on one of the plate structures at its exterior surface.

* * * * *